United States Patent [19]

Bleibtreu et al.

[11] Patent Number: 4,935,586

[45] Date of Patent: Jun. 19, 1990

[54] CYLINDRICAL STEP SELECTOR FOR STEPPED TRANSFORMERS

[75] Inventors: Alexander Bleibtreu; Leo Pillmeier, both of Regensburg, Fed. Rep. of Germany

[73] Assignee: Maschinenfabrick Reinhausen GmbH, Regensburg, Fed. Rep. of Germany

[21] Appl. No.: 389,422

[22] Filed: Aug. 3, 1989

[30] Foreign Application Priority Data

Aug. 31, 1988 [DE] Fed. Rep. of Germany ..... 3829489

[51] Int. Cl.[5] ..... H01H 19/54; H01F 29/04

[52] U.S. Cl. ..... 200/11 TC

[58] Field of Search ..... 200/8 R, 8 A, 11 B, 200/11 TC, 14, 17 R; 384/627

[56] References Cited

FOREIGN PATENT DOCUMENTS 162527 12/1949 Austria .
199759 9/1958 Austria .
2035694 6/1980 United Kingdom ..... 200/11 TC

*Primary Examiner*—J. R. Scott
*Attorney, Agent, or Firm*—Herbert Dubno; Ronald Lianides

[57] ABSTRACT

A cylinder of electrically insulating material provided with a plurality of stationary contacts has a shaft rotatably disposed therein about an axis of the cylinder and is formed with movable contact members engageable with the contacts, and a bearing assembly in which the shaft is journaled on the cylinder at least at one end thereof, the bearing assembly including at least two tubes of electrically insulating material traversing the wall of the cylinder at opposite sides thereof so that opposite ends of the tubes project beyond the cylinder, the projecting ends of the tubes having slits formed therein, and a bearing member of electrically insulating material supported centrally and nonrotatably by the tubes and supporting the shaft for relative rotation of the shaft and the bearing member, and respective wedges received in the slits for spreading the split ends of the tubes to anchor the tubes at the wall of the cylinder.

16 Claims, 5 Drawing Sheets

CYLINDRICAL STEP SELECTOR FOR STEPPED TRANSFORMERS

CROSS REFERENCE TO RELATED APPLICATIONS

This application is related to the commonly owned copending applications Ser. No. 07/389,423 and Ser. No. 07/389,429, respectively, based on German Patent application Nos. P 38 29 489.3 and P 38 27 386.1 filed 12 August 1988.

FIELD OF THE INVENTION

Our present invention relates to a cylindrical step selector provided with fixed contacts to selectively engage contact bridges with these contacts. More particularly, the invention relates to a step selector of the type described provided with a unique journaling arrangement for supporting the selector shaft.

BACKGROUND OF THE INVENTION

A cylindrical step selector for a stepped transformer can have, for example, a support structure which can be generally cylindrical and which surrounds an axis about which the selector shaft can be angularly shaped or rotated in increments. Fixed step contacts are provided in the wall of this structure and can be engaged by contact bridges forming movable contacts which can be brought into engagement with the fixed step contacts at a lower end. This shaft is supported in a journal of electrically insulating material which it supported at the lower end of the support structure by means of struts also of electrically insulating material.

A step selector of this type is described in Austrian patent document No. 162,527.

With this system, however, the journal formed for the lower end of the shaft has had less than satisfactory stability.

OBJECTS OF THE INVENTION

It is the principal object of the present invention to provide a step selector of the aforedescribed type having an improved assembly for supporting and journaling the switching shaft.

Another object of our invention is to provide an improved step selector which, without metal parts, can ensure simple, reliable and precise centering of the bearing element engageable with the lower end of the shaft and which can also improve the stability of the support structure, e.g. an electrically insulating cylinder.

SUMMARY OF THE INVENTION

These objects and others which will become more readily apparent hereinafter are attained, in accordance with the present invention, by providing a bearing member at the lower end of the step selector which is supported by struts engaged in the electrically insulating wall which are formed as tubular bars extending transversely to the longitudinal dimension of the insulating cylinder and which traverses both the bearing member and, at the opposite ends, the wall of the electrically insulating cylinder. The two ends of each bar can be slit and anchored in the wall by wedging action, i.e. a respective wedge driven into each of the slit ends.

The bearing members can be a simple sleeve or bushing which is traversed by two such bars in different planes of the cylinder and which cross one another at the cylinder axis.

The bearing member can be, alternatively, an insulating block from which the journal bushing projects upwardly and can be traversed by two mutually parallel bars traversing the block and lying in the same plane perpendicular to the axis of the cylinder. Four bars in pairs at right angles to one another can be used for greater stability, each pair of bars lying in a respective such plane.

The stability of the insulating wall can be ensured by bracing the inner surface of the wall on the bars. Such bracing can be effected by pins extending transversely through the bars along the inner surfaces of the wall, or providing spacer tubes which surround each bar and are braced both against the respective inner surface of the insulating cylinder and against the electrically insulating block. The spacer sleeves also can be composed of electrically insulating material.

The step selector of the invention, therefore, can comprise:

a cylinder of electrically insulating material provided with a plurality of stationary contacts;

a shaft rotatable in the cylinder about an axis of the cylinder and formed with movable contact members engageable with the contacts; and a bearing assembly in which the shaft is journaled on the cylinder at least at one end thereof, the bearing assembly comprising:

at least two tubes of electrically insulating material traversing the wall of the cylinder at opposite sides thereof so that opposite ends of the tubes project beyond the cylinder, the ends of the tubes projecting beyond the cylinder having slits formed therein, a bearing member of electrically insulating material supported centrally and nonrotatably by the tubes and adapted to receive the shaft, and respective wedges received in the slits and spreading the ends of the tubes to anchor the tubes on the wall.

The advantage of the bearing assembly of the invention and the step selector incorporating same, is the complete elimination of any need for metallic parts to ensure centering of the bearing member and to stabilize the bearing member and the insulating wall.

The tubular struts can be formed from wound glass-fiber-reinforced material and indeed glass-fiber-reinforced material can be used to form the contact arms, the shaft and the electrically insulated cylinder itself. Such materials, while having high mechanical strength are also relatively light weight and can easily be anchored in the wall of the insulating cylinder and in the bearing block by a wedging action. The wedges themselves may be composed of electrically insulating material. When the struts cross one another, the bearing members need not even be affixed on the struts, since the crossing orientations of the struts will accurately define the centered position of the bushing.

The ends of the struts projecting through the electrically insulating wall can slit. Wedges can be driven into the slits from the exterior so that the struts are lodged firmly in the wall of the insulating cylinder. To prevent an inward deflection of the wall, the aforementioned transverse pins or spacer tubes can brace the inner surface.

The insulating block can be formed with bores through which the struts can be passed and these bores can, of course, be provided in two parallel planes. The most stable arrangement, according to the invention, it one which employs two pairs of struts with the struts being parallel in each plane and the two pairs lie in different planes.

BRIEF DESCRIPTION OF THE DRAWING

The above objects, features and advantages of our invention will become more readily apparent from the following description, reference being made to the accompanying drawing in which.

SPECIFIC DESCRIPTION

Figure 6:
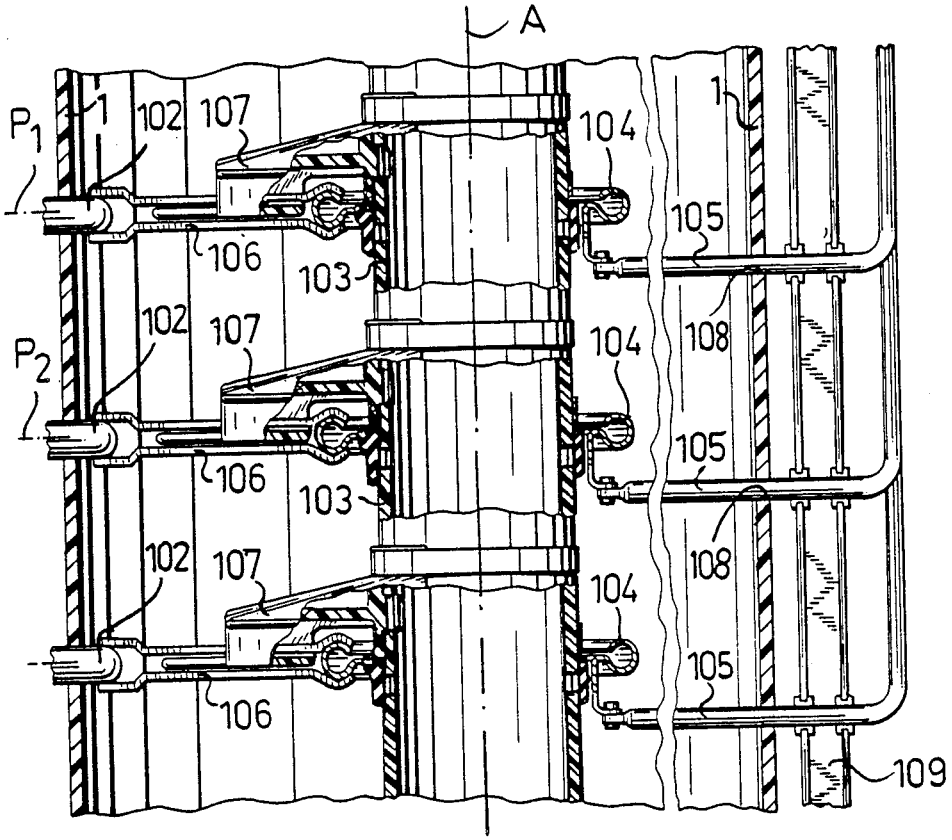
FIG. 6 is a cross-sectional view showing the cooperation of the step selector shaft with the contacts.

Referring first to FIG. 6, it will be apparent that a step selector for a stepped transformer can comprise an electrically insulating cylinder 1 which can be formed at spaced apart levels with fixed contacts 102 lying in planes $P_1$, $P_2$, etc., perpendicular to an axis A of the cylinder 1. The latter can be helically wound from glass-fiber-reinforced epoxy resin for example.

Within the cylinder 1 is a shaft 1O3 which can be provided in each of the planes $P_1$, $P_2$, . . . with a respective contact ring 104 which is nonrotatable and can be stepped within the cylinder 1 by a connector 105 whose horizontal portion can traverse a bore 108 in this cylinder and, externally of the cylinder, can be engaged between a pair of clamping bars, one of which can be seen at 109. The clamping bars operate to stabilize the rings 104 in the manner described in the aforementioned copending application Ser. No. 07/389,429.

The shaft 103 can have electrically insulated arms 107, e.g. also of glass fiber-reinforced synthetic resin which can be affixed to the shaft 103 by the technique described in the above-mentioned copending application Ser. No. 07/389,423.

As is also described in this application, a portion of each arm 107 can support a contact bridge 106 slidingly engaging the respective ring 104 and engageable with the fixed contact 102 as has been described in each of these applications, to select particular steps of a transformer which is connected in circuit with the contacts 102 and the rings 104.

The present invention primarily concerns the support bearing for the lower ends of the shaft 103 and is mounted on the cylinder wall 1 as has been illustrated in the remaining FIGURES.

Figure 1A:
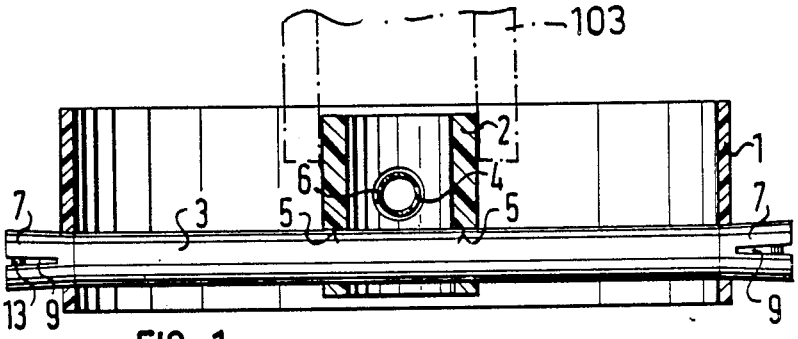
FIG. 1*a* is an axial section through a bearing assembly according to one embodiment of the invention.
Figure 1B:
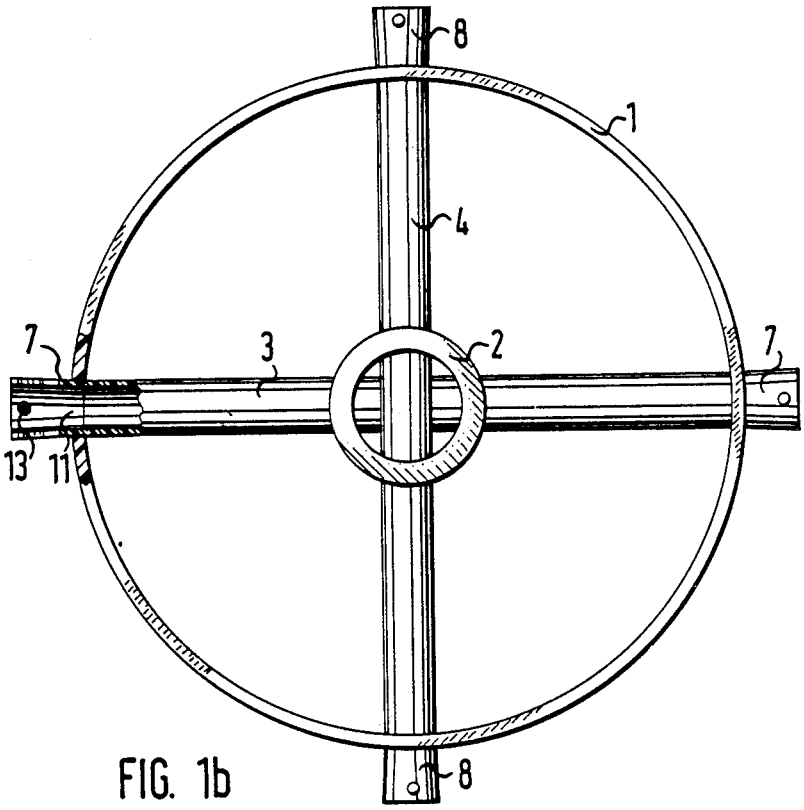
FIG. 1*b* is a bottom view thereof, partly broken away.

FIGS. 1*a* and 1*b* show a centrally located bearing bushing 2 which is supported by means of two crossing tubular struts 3, 4 of wound electrically insulating material, e.g. hardened epoxy impregnated glass fiber strips.

Each bar 3 of 4 passes snugly through a respective bore 5 or 6 in the bearing bushing 2 in a respective plane parallel to the planes $P_1$, $P_2$, . . . previously described.

Figure 4:
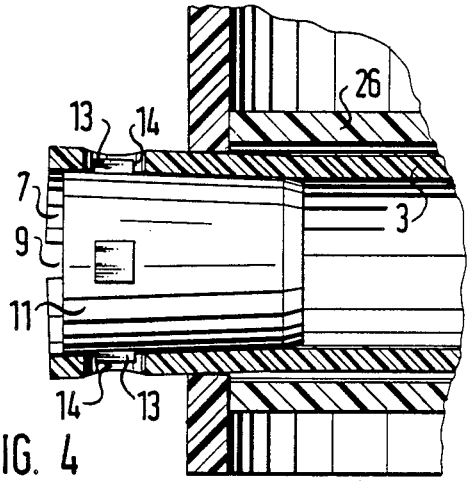
FIGS. 4 and 5 are cross-sectional views illustrating two embodiments of bracing of the inner surface of the cylinder wall and usable with any of the three embodiments of FIGS. 1*a*–3*b*.

The ends 7 and 8 of these bars traverse respective bores formed in the wall of the insulating cylinder 1. The ends 7 and 8 of the tubular bars 3 and 4 which project beyond the insulating cylinder are provided with slits 9 which can be spread by the electrically insulating wedges 11 driven into them so that these ends are fixed and immovably seated in the wall of the insulating cylinder 1. The wedge 11 can be secured against working out by projections or detents 13 (compare FIGS. 4 and 5).

Figure 2A:
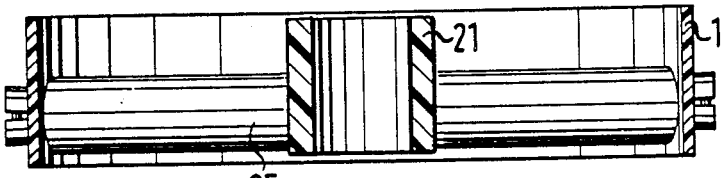
FIGS. 2*a* and 2*b* are views similar to FIGS. 1*a* and 1*b* of an embodiment of the invention in which two parallel struts are used.
Figure 2B:
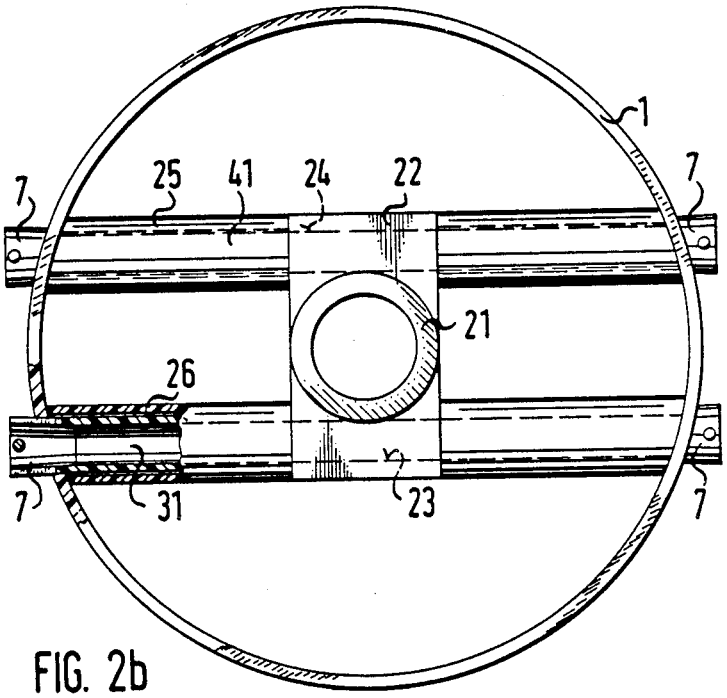

As can be seen from FIGS. 2*a* and 2*b*, the bearing bushing 21 is formed as a boss upon an electrically insulating bearing block 22. The bearing block 22 is provided with two parallel bores 23 and 24 which laterally flank and pass by the bushing 21 so that the block 22 and thus the bushing 2 can be fixed by means of two parallel tubular bars 31 and 41.

To prevent shifting of the block 22 along the bars, spacer tubes 25 and 26 of the electrically insulating material can be slid over the bars 31 and 41.

The spacer tubes can brace against the block 22 and the inner surface of the wall of the insulating cylinder and thus further stabilize the latter. The ends 7 of the bars 31 and 41 are affixed to the wall 1 in the manner previously described.

Figure 3A:
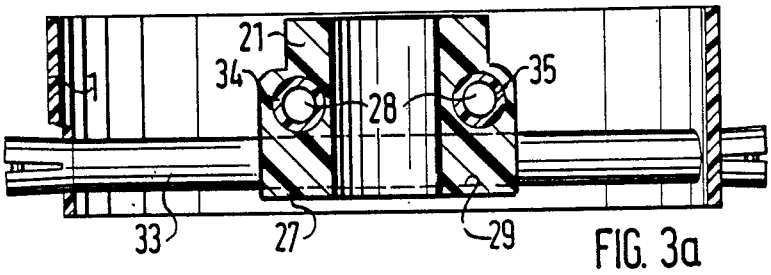
FIGS. 3*a* and 3*b* are views similar to FIGS. 1*a* and 1*b* of an embodiment it which two pairs of parallel struts are used.
Figure 3B:
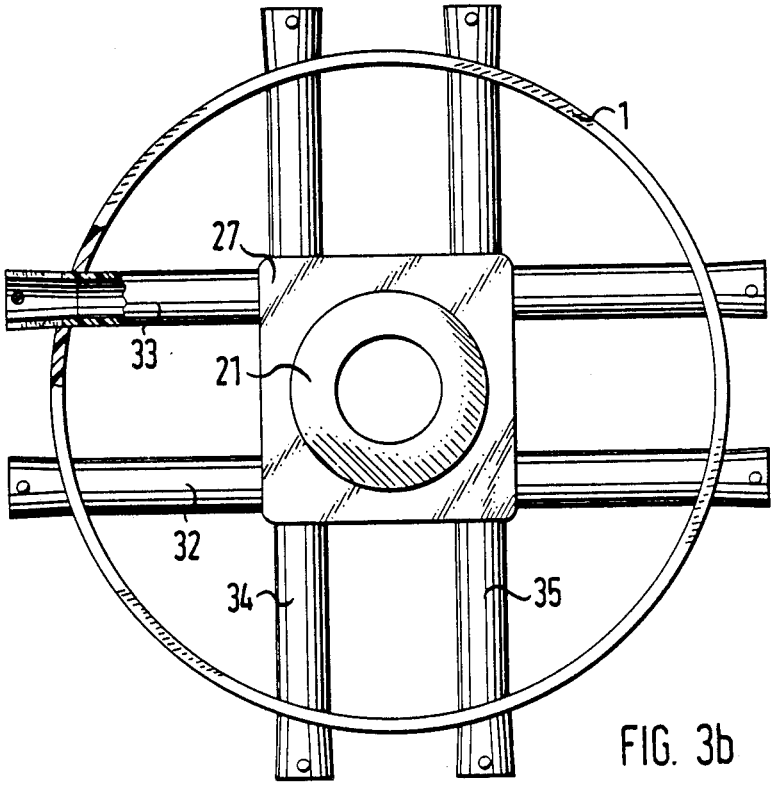

FIGS. 3*a* and 3*b* illustrate a further modification of the assembly of FIGS. 2*a* 2*b*.

Here the insulating block 27 provided with the bearing bushing 21 has two crossing pairs of bores 28, 29 to accommodate two pairs of mutually parallel bars 32, 33 and 34, 35 so that the bars of the two pairs cross one another.

The parallel bars 32, 33, therefore, lie in a plane different from that of the other bars 34, 35. These bars can be provided with spacer tubes to further increase the stability of the insulating cylinder, although such tubes are not necessary to position the block 27. This embodiment has the highest stability of all of the embodiments described.

. From FIG. 4, it is possible to see more clearly how the tubular bar 3, for example, is fastened in the wall of the insulating cylinder 1. The slit 9 at the end 7 is spread by the wedge 11 driven into the end 7 from the exterior until the detent 13 of the wedge engages in a corresponding recess 14 of the bar so that the wedge is prevented from working out of the slit. The spacer tube 6 prevents deformation of the insulating cylinder 1 and is braced against the inner surface of the latter.

Figure 5:
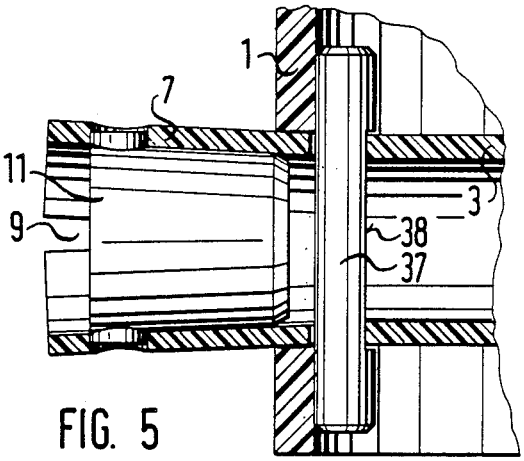

As can be seen from FIG. 5, instead of a spacer tube, a transverse pin 37 of electrically insulating material can lie against the inner surface of the cylinder 1 and can be anchored in the bar 3, thereby fixedly positioning the bar with respect to the wall of the cylinder. In this embodiment as well, a slit 9 is provided in the end 7 and is spread by the wedge 11. Recesses 38 prevent the pin 37 from falling out. It will be appreciated further that the lower end of the insulating cylinder can be provided with an insulating ring which is independent from the cylinder wall carrying the stationary contacts and can lie below the latter. While the bushings have also been illustrated so that the shaft 103 can rotate around them, it will be understood that the shaft can also be received in such bushings to provide the journaling action as may be desired.

We claim:

1. A cylindrical step selector for a stepped transformer, comprising:

a cylinder of electrically insulating material provided with a plurality of stationary contacts;

a shaft rotatable in said cylinder about an axis of said cylinder and formed with movable contact members engageable with said contacts; and a bearing assembly in which said shaft is journaled on said cylinder at least at one end thereof, said bearing assembly comprising:

at least two tubes of electrically insulating material traversing a wall of said cylinder at opposite sides thereof so that opposite ends of said tubes project beyond said cylinder, said ends of said tubes projecting beyond said cylinder having slits formed therein, a bearing member of electrically insulating material supported centrally and nonrotatably by said tubes and supporting said shaft for relative rotation of said shaft and said bearing member, and respective wedges received in said slits and spreading said ends of said tubes to anchor said tubes on said wall.

2. The step selector defined in claim 1 wherein said bearing member is a bushing transfixed by said tubes and said tubes lie in differing planes perpendicular to said axis and cross at said axis.

3. The step selector defined in claim 1 wherein said bearing member is a block of electrically insulating material provided with a bushing journaling said shaft, said block being traversed by said tubes, said tubes forming a pair of tubes lying in a common plane perpendicular to said axis and being parallel to one another and on opposite sides of said bushing.

4. The step selector defined in claim 3, further comprising another pair of said tubes lying in a common plane perpendicular to the axis and spaced from the first mentioned plane and parallel to one another, the tubes of said other pair being oriented at 90° to the tubes of the first-mentioned pair.

5. The step selector defined in claim 1 wherein each of said tubes is provided with a respective pin of electrically insulating material lying against an inner surface of said wall and extending transversely to the respective tube.

6. The step selector defined in claim 1, further comprising a spacer sleeve of electrically insulating material between said bearing member and an inner surface of said wall and surrounding each of said tubes.

7. A bearing assembly for journaling an end of a shaft in a cylinder having a cylindrical wall of electrically insulating material, said assembly comprising:

at least two tubes of electrically insulating material traversing said wall of said cylinder at opposite sides thereof so that opposite ends of said tubes project beyond said cylinder, said ends of said tubes projecting beyond said cylinder having slits formed therein;

a bearing member of electrically insulating material supported centrally and nonrotatably by said tubes and supporting said shaft for relative rotation of said shaft and said bearing member;

respective wedges received in said slits and spreading said ends of said tubes to anchor said tubes on said wall; and respective formations on said wedges and said ends of said tubes for retaining said wedges in said slits.

8. The assembly defined in claim 7 wherein said bearing member is a bushing transfixed by said tubes and said tubes lie in different planes perpendicular to said axis and cross at said axis.

9. The assembly defined in claim 8 wherein each of said tubes is provided with a respective pin of electrically insulating material lying against an inner surface of said wall and extending transversely to the respective tube.

10. The assembly defined in claim 8, further comprising a spacer sleeve of electrically insulating material between said bearing member and an inner surface of said wall and surrounding each of said tubes.

11. The assembly defined in claim 7 wherein said bearing member is a block of electrically insulating material provided with a bushing journaling said shaft, said block being traversed by said tubes, said tubes forming a pair of tubes lying in a common plane perpendicular to said axis and being parallel to one another and on opposite sides of said bushing.

12. The assembly defined in claim 11 wherein each of said tubes is provided with a respective pin of electrically insulating material lying against an inner surface of said wall and extending transversely to the respective tube.

13. The assembly defined in claim 11, further comprising a spacer sleeve of electrically insulating material between said bearing member and an inner surface of said wall and surrounding each of said tubes.

14. The assembly defined in claim 11, further comprising another pair of said tubes lying in a common plane perpendicular to the axis and spaced from the first mentioned plane and parallel to one another, the tubes of said other pair being oriented at 90° to the tubes of the first-mentioned pair.

15. The assembly defined in claim 14 wherein each of said tubes is provided with a respective pin of electrically insulating material lying against an inner surface of said wall and extending transversely to the respective tube.

16. The assembly defined in claim 14, further comprising a spacer sleeve of electrically insulating material between said bearing member and an inner surface of said wall and surrounding each of said tube.

* * * * *